United States Patent [19]

Kopp

[11] Patent Number: 4,632,003

[45] Date of Patent: Dec. 30, 1986

[54] MUSICAL INSTRUMENT SOUND QUALITY ENHANCEMENT DEVICE

[76] Inventor: William L. Kopp, 60 Miller Rd., New Oxford, Pa. 17350

[21] Appl. No.: 754,945

[22] Filed: Jul. 15, 1985

[51] Int. Cl.[4] ..... G10D 1/08; G10G 7/00; G10H 3/18

[52] U.S. Cl. ..... 84/1.16; 84/267; 84/290; 84/453

[58] Field of Search ..... 84/1.14–1.16, 84/267, 290, 453

[56] References Cited

U.S. PATENT DOCUMENTS

| | | | |
|---|---|---|---|
| 3,636,809 | 1/1972 | Ezaki | 84/263 |
| 4,024,788 | 5/1977 | Dunlap | 84/267 |
| 4,394,830 | 7/1983 | Damiano | 84/1.15 |

*Primary Examiner*—S. J. Witkowski

*Attorney, Agent, or Firm*—Samuel M. Learned, Jr.

[57] ABSTRACT

A musical instrument sound quality enhancement device comprised of a circular shaped planer sound hole cover adapted by opposingly positioned underside sets of spaced angularly outward and downward projecting pliable affixment fingers to thereby enable insertably installed occlusive attachment of the cover within the circular shaped sound hole opening of a guitar, banjo, ukulele, dulcimer or any similar such stringed instrument the use of which eliminates feedback interference otherwise common to an amplifier equipped instrument of the type described, or with a ported variably occlusive sound hole cover version thereof not only accomplish amplifier feedback interference elimination when employed in a port fully closed configuration but when employed in a port variably set occlusive sound hole cover partially open configuration alternately effect instrumental tonal variations.

12 Claims, 12 Drawing Figures

(a)
(b)
(c)
(d)
(e)
(f)
(g)
(h)
A B C D E F G H J

MUSICAL INSTRUMENT SOUND QUALITY ENHANCEMENT DEVICE

BACKGROUND OF THE INVENTION

In the drawings accompanying this specification are illustrated various embodiments of the instant invention, wherein it is to be understood that similar reference characters in the different views designate corresponding parts throughout. Likewise, although a guitar of rather typical and conventional design is shown as being indicative of that type of musical instrument with which said invention and the alternate embodiments thereof are employed, it is further to be understood that the showing of such a guitar is intended to be illustrative only and not specifically limited per se thereto, but includes also various other musical instruments of the type having a fret board with a plurality of strings stretched therealong together in attachment upon a hollow body provided with a sound hole for effecting acoustic communication such as is structurally indicative, for example, of the banjo, ukulele, dulcimer, and the like.

More specifically, the instant invention comprises a musical instrument sound quality enhancement device in two embodiments respectively operable in two modes, the first embodiment being a simple and effective fully occlusive sound hole cover means whereby is enabled control of feedback interference in an electrical sound amplified stringed instrument system as well as a fixed tonal color variation change thereof when employed upon an instrument not utilizing the electrical sound amplification feature, and the second embodiment being a variably occlusive ported sound hole cóver version which not only provides the foregoing electrically amplified feedback interference control feature but also enables one to effect selective tonal color variations of the stringed instrument by variable occlusion of the ported sound hole cover opening. Both of the invention embodiments and disclosed variations thereof employ in common opposingly positioned sets of spaced angularly outward and downward projecting pliable affixment fingers which enable mechanically cooperative insertably installed detachable attachment of the device within the stringed instrument circular shaped sound hole.

A sound hole cover feedback reducer for an acoustic electric guitar is known in the art, exemplary of which is that device as taught by Damiano in U.S. Pat. No. 4,394,830 dated July 26, 1983, and in particular that embodiment thereof as shown in FIG. 5 wherein a sound hole cover member is integrally provided with a plurality of resilient finger members being shaped with so-called "inclined detent cam surfaces" operable for effecting cover retention by deforming radially inward during sound hole insertable installation and returning to the undeformed retention attitude once insertable cover affixment has been accomplished and thereby collectively function to hold the cover in place.

A tone modifying sound hole cover device employment technique is taught by Ezaki in his U.S. Pat. No. 3,636,809 dated Jan. 25, 1972, wherein an instrument provided with dual opposingly positioned sound holes is made capable of generating a variety of tonal colors by the selective total occluding, or full opening thereof.

Lastly, a second hole cover mute is known in the art, as is taught for example by that construction shown in the FIG. 13 and 14 embodiments of U.S. Pat. No. 4,024,788 to Dunlap dated May 24, 1977, whereby the muting of a guitar is accomplished with a fully occlusive sound hole cover being provided with a downward projecting resilient member which extends into the sound hole covered thereby.

The instant invention, however, provides new and useful features in the art of musical instrument sound quality enhancement by a combination of elements not taught by the prior art, resulting in the present structures embodying construction features of novel merit as set forth hereinafter.

SUMMARY OF THE INVENTION

It is the principal object of the present invention to provide a musical instrument sound quality enhancement device adapted by means of opposingly positioned underside sets of spaced angularly outward and downward projecting pliable affixment fingers to be employed by insertably installed combination with the sound hole opening of a stringed musical instrument of that type having a fret board and a sound hole.

It is another object of the present invention to provide a sound quality enhancement device adapted to be insertably installed and detachably retained within the sound hole opening of a musical instrument of the above-mentioned type.

It is also an object of the present invention to provide a sound quality enhancement device adapted to accommodate insertable retention within musical instrument sound holes having different diameters.

It is an additional object of the instant invention to provide a relatively simple and inexpensive sound quality enhancement device which will function to effectively eliminate internal pickup feedback interference otherwise normally associated with acoustic electric-/amplifier system equipped musical instruments of the type herein described.

A further object of the instant invention is to provide a sound quality enhancement device embodying a ported variably occlusive sound hole cover opening whereby selective partially open adjustment thereof enables variation and control of the instrument tone range.

It is a further object of the instant invention to provide a sound quality enhancement device which may be employed in combination with a stringed instrument of the type herein considered wherein there is no requirement for structural modification of the instrument nor any hazard of otherwise marring or scratching the instrument finish.

Yet another object of the present invention is to provide a sound quality enhancement device which, at times the instrument is not in use, may alternately function in the fully occluded configuration as a sound hole dust guard cover.

The foregoing, and other objects hereof, will be readily evident upon a study of the following specification and accompanying drawings comprising a part thereof.

DETAILED DESCRIPTION OF THE INVENTION

Figure 1:
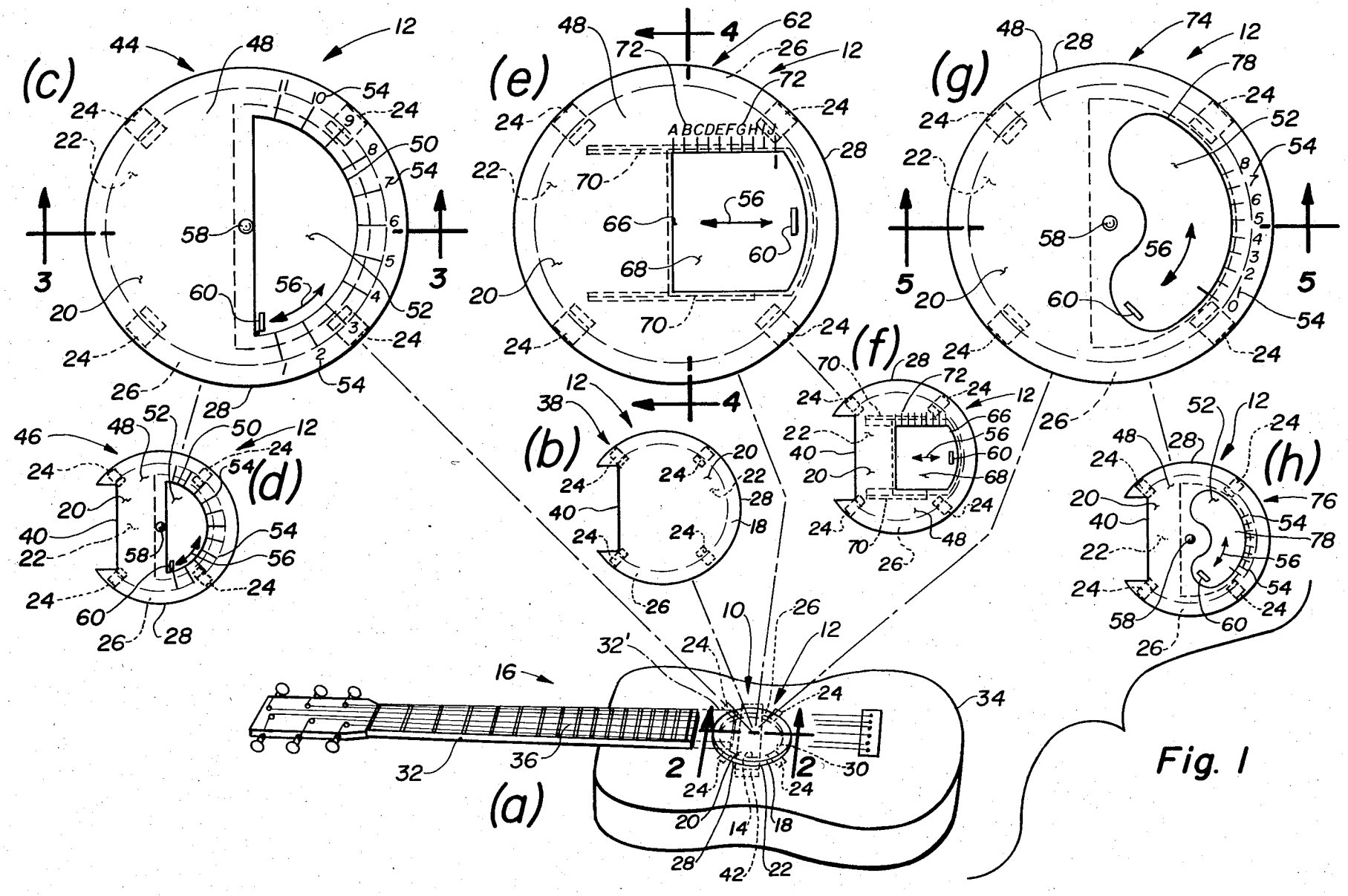
FIG. 1 is a compound perspective view wherein the 1 (*a*) portion thereof shows a typical stringed instrument having a fret board and a circular shaped sound hole therein illustrating the combined insertable sound hole occlusive installation of one embodiment of the sound quality enhancement device of instant invention in combination therewith, with alternate embodiment illustrations of said device being shown in the 1 (*b*) through 1 (*h*) portions thereof.

Referring to FIG. 1 (*a*), the fully occlusive version 10 of the musical instrument sound quality enhancement device 12 of instant invention is shown in insertably installed disposition within the circular shaped sound hole opening 14 of a typical exemplary stringed musical instrument 16 of that type generally suitable for use of said device 12 in combination therewith, wherein said device 12 is provided in this instance with a solid circular shaped planer sound hole cover member 18 being preferably circular in shape and having a topside planer surface 20 and a parallelly spaced underside planer surface 22 and integral therewith opposingly positioned underside sets of spaced angularly outward and downward projecting pliable affixment fingers 24 whereby said device 12 is detachably installed within said sound hole opening 14 of said instrument 16, and in order to prevent either scratching or marring of the instrument finish in that area of immediate encirclement of said sound hole opening 14, said underside planer surface 22 is further provided with a non-abrading pliable material cushioning gasket member 26 such as felt or the like affixed by adhesive means or some similarly suitable attachment technique to be retainably held in supported disposition extending inward of the underside planer surface peripheral boundary 28 in a uniformly equal circumferential distance approximately coincident with that which describes the sound hole opening peripheral boundary 30.

Prior to proceeding into a more detailed description of the invention it should be noted, as will hereinafter more fully be explained with reference to subsequently described FIGS. 1 (*b*) through 1 (*h*) also illustrated in the FIG. 1 series of drawings, that each version of said device 12 and respectively an alternate embodiment thereof are to be regarded as exemplary only and not per se specifically limiting of that structure which may be otherwise covered by the claims.

Referring again to FIG. 1 (*a*) to describe in greater detail the component parts of this invention as well as explain the structurally cooperative features thereof, and as additionally shown therein said musical instrument 16 is provided with a fret board 32 and a hollow body 34 with a plurality of strings 36 connectably assembled therebetween in tensioned communication over said sound hole opening 14 whereby the acoustic character and inherent tone color of said instrument 16 are produced. The fret board 32 proximity of extension of an instrument 16 with respect to the sound hole opening 14 thereof is approximate and not a standardized dimensional relationship, whereby said fret board 32 may not extend to the sound hole opening 14 as principally shown in solid line rendition illustration in FIG. 1 (*a*), or, the fret board 32 may extend to and partially cover said sound hole opening 14 as alternately shown in phantom line rendition illustration in FIG. 1 (*a*). Also, although not per se illustrated in FIG. 1 (*a*) for purposes of greater clarity, said sound hole opening 14 likewise is not of a standardized dimensional relationship and may vary in size from instrument-to-instrument by as much as one-eighth of an inch or so.

With respect to accommodating instruments 16 with a device 12 when said instrument 16 is provided with an extended fret board 32′, an alternate embodiment fully occlusive version 38 of said musical instrument sound quality enhancement device 12 having a fret board detent cut-out 40 is provided, generally as shown in FIG. 1 (*b*). The technique of installing said device 12 whether it be a primary or alternate embodiment form thereof in detachably installed affixment within the sound hole opening 14 of an instrument 16 is as illustrated in phantom in FIG. 2, to be hereinafter more fully described.

Considering again FIG. 1 (*a*) with respect to the utility features of said device 12 when utilized as shown. If the musical instrument 16 is sound amplified with an internal pick-up system, the fully occlusive version 10 of said device 12, or the alternate embodiment 38 thereof as shown in FIG. 1 (*b*), both function to insulate the internally contained amplifier pick-up head 42 from external interference which is otherwise communicated through an uncovered sound hole opening 14 during sound amplified use. Alternately, if employed on an unamplified musical instrument 16 in the manner illustrated in FIG. 1 (*a*), the fully occlusive version 10 of said device 12, or the alternate embodiment 38 thereof both function in performance utilization of said instrument 16 to modify the tone color of the same in a manner similar to that of a mute. And, when employed upon a non-utilized instrument 16 in the manner illustrated in FIG. 1 (*a*), the fully occlusive version 10 of said device 12, or alternate embodiment 38 thereof, both function as a sound hole opening 14 dust cover. It should be noted at this point that all versions of said device 12 as previously and to be hereinafter discussed, depending upon the mode of utilization, function in one or more of the foregoing three ways.

Concurrently considering now the semi-circular variably occlusive ported version 44 of said device 12 as shown in FIG. 1 (*c*), and the alternative embodiment semi-circular variably occlusive ported version 46 thereof as shown in FIG. 1 (*d*), wherein the single structural difference therebetween is that the alternate embodiment version 46 incorporates the fret board detent cut-out 40 feature as previously described. As shown in both of the referenced Figures, the circular shaped planer sound hole cover member 48 in this case is not solid but rather has provided therein a semi-circular port opening 50 capable of being fully occluded or opened variably to fully by means of a semi-circular pivot panel 52 variably and infinitely through numbered reference arcs 54 as indicated by the arrow 56 about a panel 52 to sound hole cover member 48 connectably intercommunicating pivot pintle 58 by means of indexing handle 60.

In the fully occluded position setting of said semi-circular pivot panel 52, as shown in both FIG. 1 (*c*) and 1

(*d*), said semi-circular variably occlusive ported version 44 and the alternate embodiment 46 version thereof function as a musical instrument sound quality enhancement device 12 by insulating an amplifier equipped pick-up head from external interference as previously described, or when employed in a fully occluded position setting upon a non-utilized instrument function as a sound hole opening 14 dust cover also as previously described. However, when said semi-circular pivot panel 52 is set by means of indexing handle 60 to a position other than that of full semi-circular port opening 50 occlusion, the tonal quality of an instrument may be thereby incrementally varied in order to produce uniquely individualized musical effects by either infinitely selective variable port opening 50 setting or by simple setting to a selected number reference with regard to said port opening 50.

As before, the means of detachable affixment within the sound hole opening 14 of a musical instrument 16 of either the semi-circular variably occlusive ported version 44, or the alternate embodiment 46 thereof, of said device 12, is by way of the opposingly positioned underside sets of spaced angularly outward and downward projecting pliable affixment fingers 24 as previously discussed, and as more specifically shown in FIG. 3 to be hereinafter described in greater detail.

Considering now a concurrent description in detail of the FIG. 1 (*e*) and 1 (*f*) illustrations respectively showing the sliding panel variably occlusive ported version 62 and the alternate embodiment sliding panel variably occlusive ported version 64 thereof, of said device 12, wherein within the circular shaped planer sound hole cover member 48 thereof a generally rectangular port opening 66 is provided being variably occlusive with a sliding panel 68 supportably moveable by means of indexing handle 60 from a fully port occlusive disposition as illustrated to various partially open to fully open configurations within integral panel support and guide tracks 70 relative to lettered port opening reference settings 72 as indicated by the arrow 56. All other utility, function, and use features and methods as previously described for the variably ported 44 and 46 versions of said device 12 as heretofore recited are equally applicable to the 62 and 64 versions thereof, and are not, therefore, herein repeated.

Considering lastly in the FIG. 1 series of illustrations those respectively shown in FIG. 1 (*g*) and 1 (*h*), being the kidney-shaped opening variably occlusive ported version 74 and the alternate embodiment kidney-shaped opening variably occlusive ported version 76 thereof, of said device 12, wherein in this case within the circular shaped planer sound hole cover member 48 thereof a generally kidney-shaped port opening 78 is provided being variably occlusive with the semi-circular pivot panel 52 infinitely through numbered reference arcs 54 as indicated by the arrow 56 in angular displacement about the connectably intercommunicating pivot pintle 58 as previously described.

As previously explained, the alternate embodiment 76 version differs only from the basic 74 version of said device 12 by the provision of a fret board detent cut-out 40 so as to accommodate installation upon an instrument 16 having an extended fret board 32'. Also, the means of detachable affixment within the sound hole opening 14 of a musical instrument 16 of either the kidney-shaped opening variably occlusive ported version 74, or the alternate embodiment 76 thereof, of said device 12, is by way of the opposingly positioned sets of spaced angularly outward and downward projecting pliable affixment fingers 24 as previously discussed, and as more specifically shown in FIG. 5 to be hereinafter described in greater detail. All other utility, function, and use features and methods as previously described for the variably ported 44 and 46 versions of said device 12 as heretofore recited are equally applicable to the 74 and 76 versions thereof, and are not, therefore, herein repeated.

The musical instrument sound quality enhancement device in accordance with the instant invention, and the various versions and respective alternate embodiments thereof as shown in the FIG. 1 series of illustrations, consists generally of a blow molded unitary member of dense pliable material such as polyethylene or rubber, or any of various other synthetic or natural materials of similar structural, processing, and durability characteristics, or a combination thereof.

Figure 2:
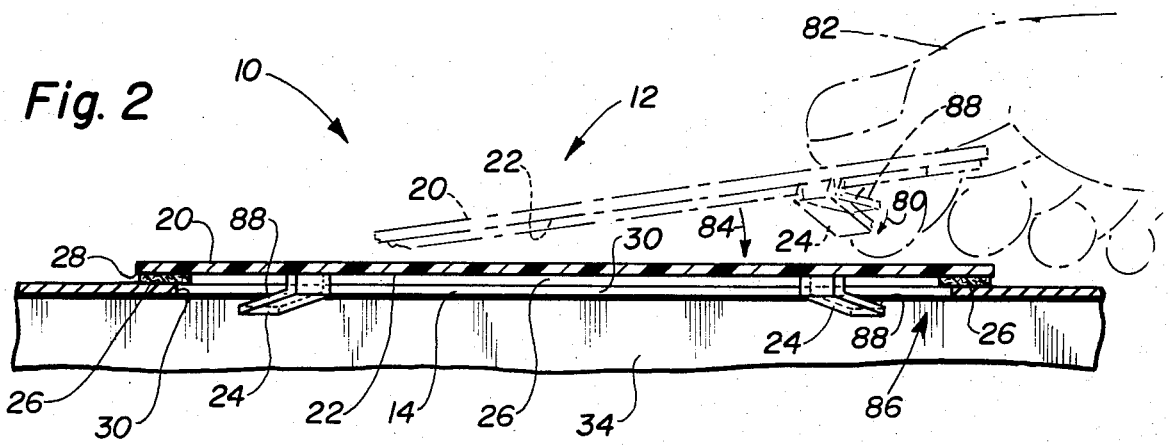
FIG. 2 is an enlarged side elevation of the FIG. 1 (*a*) embodiment of the instant invention as seen along the line 2—2 thereof, with an additional showing in phantom of the insertable sound hole installation of said device by means of the spaced and angularly outward projecting pliable affixment fingers.

The illustration of FIG. 2 shows an enlarged side sectional elevation view of the fully occlusive version 10 of said musical instrument sound quality enhancement device 12 as seen along the line 2—2 of FIG. 1 (*a*) as the same would appear when operationally installed in detachable affixment within the sound hole opening 14 of the hollow body 34 of a typical stringed musical instrument, showing also in phantom illustration the preferred installation technique being by the downward finger deflection of the pliable affixment finger 24 as indicated by the arrow 80 manually by the installer's hand 82 so said finger 24 is made to clear the edge of the sound hole opening 14 followed by pivotally downward insertion thereof as indicated by the arrow 84 against the previously insertably engaged opposingly positioned underside set of spaced angularly outward and downward projecting pliable affixment fingers 24, effecting installation of said device 12. It will be noted, as a consequence of the resiliency of said pliable affixment fingers 24, and the so-called "memory factor" of deformed plastic substances to return to their original undeformed configuration, the finger 24 returns to the disposition shown in solid line rendition as illustrated in FIG. 2, thereby exerting an upward compressive force as indicated by the arrow 86 whereby the interior finger cam surface 88 operates to effect opposing compressive affixment force therebetween cooperatively upon the sound hole opening peripheral boundary 30 with the non-abrading pliable material cushioning gasket member 26 in effecting said aforesaid installation. It should be noted that all versions of said device 12 and the respective alternate embodiments thereof as illustrated in the FIG. 1 series, and FIGS. 2 through 5, are detachably installed within the sound hole opening of a stringed instrument in that manner as above described.

Figure 3:
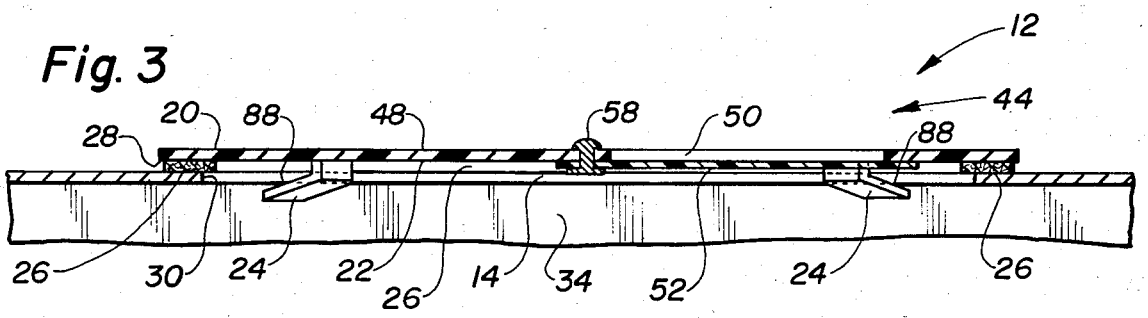
FIG. 3 is an enlarged side elevation of the FIG. 1 (*c*) embodiment of the instant invention as seen along the line 3—3 thereof.
Figure 5:
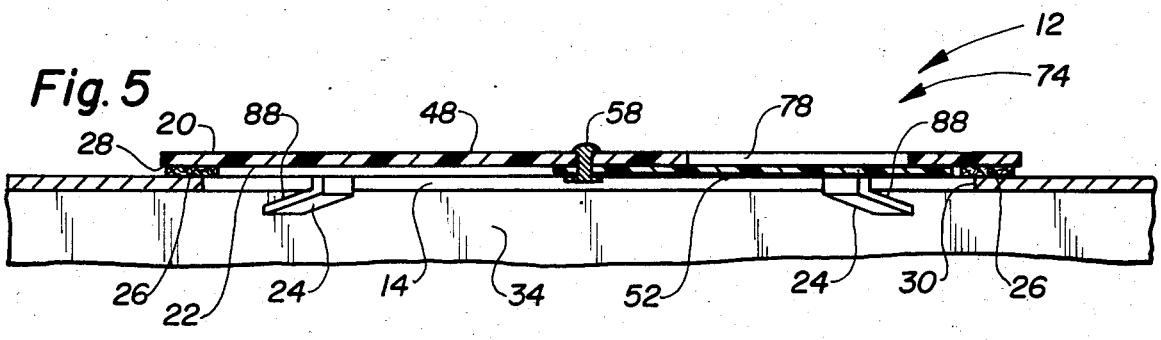
FIG. 5 is an enlarged side elevation of the FIG. 1 (*g*) embodiment of the instant invention as seen along the line 5—5 thereof.

The views shown in FIGS. 3 and 5 are enlarged sectional elevations of the semi-circular variably occlusive ported version 44 and the kidney-shaped opening variably occlusive ported version 74 respectively of said device 12, showing in greater detail, among other things, the pivot pintle 58 which functions in each of the foregoing versions and the alternate embodiments thereof to effect pivotally connectable intercommunication between the circular shaped planer sound hole cover members 48 and the semi-circular pivot panels 52 respectively thereof, wherein it is to be noted that said pivot pintles 58 may be constructed of metal, metal alloys, plastic materials, or a combination thereof.

Figure 4:
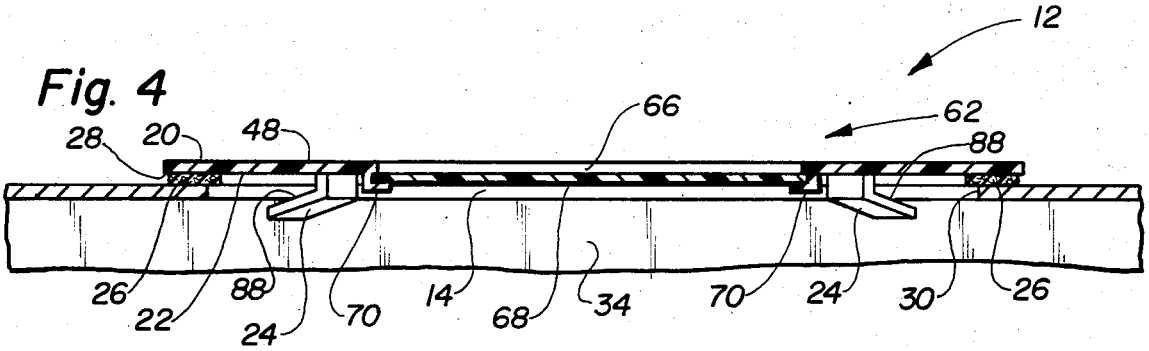
FIG. 4 is an enlarged side elevation of the FIG. 1 (*e*) embodiment of the instant invention as seen along the line 4—4 thereof.

Considering lastly the view shown in FIG. 4, which is an enlarged sectional elevation of the sliding panel variably occlusive ported version 62, showing in greater detail the mechanically cooperative assembly of the sliding panel 68 and the panel support and guide tracks 70 of this version and the corresponding alternate embodiment thereof of said device 12.

Although the invention has been herein shown and described in what are conceived to be the most practical and preferred embodiments, it is recognized that departures may be made therefrom within the scope of the invention, which is not to be limited to the details disclosed herein but is to be accorded the full scope of the claims so as to embrace any and all equivalent devices.

I claim:

1. A musical instrument sound quality enhancement device adapted to be detachably installed upon a musical instrument having a fret board mounted upon a hollow body disposing supportably therebetween a plurality of tensioned strings over a circular shaped sound hole opening in said hollow body and provided with an internally mounted acoustic electric pick-up head, comprising in combination said musical instrument, a circular shaped planer sound hole cover member having a topside planer surface and a parallelly spaced underside planer surface respectively with a circular dimension at least larger than that of said circular shaped sound hole opening to thereby provide a uniformily overlapping underside planer surface peripheral boundary adapted for supportable contact thereof about said circular shaped sound hole opening in said hollow body said underside surface being further provided with an integral pair of opposingly positioned underside set of spaced angularly outward and downward projecting pliable affixment fingers adapted to insertably engage said circular shaped sound hole opening and compressively conform by means of a resilient finger cam surface respectively provided upon each of said affixment fingers said underside planer surface peripheral boundary of said circular shaped planer sound hole cover member in sealable contact to said hollow body in which said circular shaped sound hole opening is disposed, and a semi-circular port opening provided in said circular shaped planer sound hole cover member said semi-circular port opening being adjustably occluded by means of a semi-circular pivot panel adapted to cooperatively rotate upon a pivot pintle in manually variable adjustment from a fully closed to a fully open position whereby in the fully closed position feedback interference through said sound hole opening to said internally mounted acoustic electric pick-up head is eliminated and in a manually adjusted variably open to the fully open set position a corresponding variation in tonal character of said musical instrument is realized.

2. The musical instrument sound quality enhancement device according to claim 1 in which said circular shaped planer sound hole cover member is provided with a fret board detent cut-out.

3. A musical instrument sound quality enhancement device adapted to be detachably installed upon a musical instrument having a fret board mounted upon a hollow body disposing supportably therebetween a plurality of tensioned strings over a circular shaped sound hole opening in said hollow body, comprising in combination said musical instrument, a circular shaped planer sound hole cover member having a topside planer surface and a parallelly spaced underside planer surface respectively with a circular dimension at least larger than that of said circular shaped sound hole opening to thereby provide a uniformily overlapping underside planer surface peripheral boundary adapted for supportable contact thereof about said circular shaped sound hole opening in said hollow body said underside surface being further provided with an integral pair of opposingly positioned underside set of spaced angularly outward and downward projecting pliable affixment fingers adapted to insertably engage said circular shaped sound hole opening and compressively conform by means of a resilient finger cam surface respectively provided upon each of said affixment fingers said underside planer surface peripheral boundary of said circular shaped planer sound hole cover member in sealable contact to said hollow body in whih said circular shaped sound hole opening is disposed, and a semi-circular port opening provided in said circular shaped planer sound hole cover member said semi-circular port opening being adjustably occluded by means of a semi-circular pivot panel adapted to cooperatively rotate upon a pivot pintle in manually variable adjustment from a fully closed to a fully open position whereby in a manually adjusted variably open to the fully open set position a corresponding variation in tonal character of said musical instrument is realized.

4. The musical instrument sound quality enhancement device according to claim 3 in which said circular shaped planer sound hole cover member is provided with a fret board detent cut-out.

5. A musical instrument sound quality enhancement device adapted to be detachably installed upon a musical instrument having a fret board mounted upon a hollow body disposing supportably therebetween a plurality of tensioned strings over a circular shaped sound hole opening in said hollow body and provided with an internally mounted acoustic electric pick-up head, comprising in combination said musical instrument, a circular shaped planer sound hole cover member having a topside planer surface and a parallelly spaced underside planer surface respectively with a circular dimension at least larger than that of said circular shaped sound hole opening to thereby provide a uniformily overlapping underside planer surface peripheral boundary adapted for supportable contact thereof about said circular shaped sound hole opening in said hollow body said underside surface being further provided with an integral pair of opposingly positioned underside set of spaced angularly outward and downward projecting pliable affixment fingers adapted to insertably engage said circular shaped sound hole opening and compressively conform by means of a resilient finger cam surface respectively provided upon each of said affixment fingers said underside planer surface peripheral boundary of said circular shaped planer sound hole cover member in sealable contact to said hollow body in which said circular shaped sound hole opening is disposed, and a kidney shaped port opening provided in said circular shaped planer sound hole cover member said kidney shaped port opening being adjustably occluded by means of a semi-circular pivot panel adapted to cooperatively rotate upon a pivot pintle in manually variable adjustment from a fully closed to a fully open position whereby in the fully closed position feedback interference through said sound hole opening to said internally mounted acoustic electric pick-up head is eliminated and in a manually adjusted variably open to the fully open set position a corresponding variation in tonal character of said musical instrument is realized.

6. The musical instrument sound quality enhancement device according to claim 5 in which said circular shaped planer sound hole cover member is provided with a fret board detent cut-out.

7. A musical instrument sound quality enhancement device adapted to be detachably installed upon a musical instrument having a fret board mounted upon a hollow body disposing supportably therebetween a plurality of tensioned strings over a circular shaped sound hole opening in said hollow body, comprising in combination said musical instrument, a circular shaped sound hole cover member having a topside planer surface and a parallelly spaced underside planer surface respectively with a circular dimension at least larger than that of said circular shaped sound hole opening to thereby provide a uniformily overlapping underside planer surface peripheral boundary adapted for supportable contact thereof about said circular shaped sound hole opening in said hollow body said underside surface being further provided with an integral pair of opposingly positioned underside set of spaced angularly outward and downward projecting pliable affixment fingers adapted to insertably engage said circular shaped second hole opening and compressively conform by means of a resilient finger cam surface respectively provided upon each of said affixment fingers said underside planer surface peripheral boundary of said circular shaped planer sound hole cover member in sealable contact to said hollow body in which said circular shaped sound hole opening is disposed, and a kidney shaped port opening provided in said circular shaped planer sound hole cover member said kidney shaped port opening being adjustably occluded by means of a semi-circular pivot panel adapted to cooperatively rotate upon a pivot pintle in manually variable adjustment from a fully closed to a fully open position whereby in a manually adjusted variably open to the fully open set position a corresponding variation in tonal character of said musical instrument is realized.

8. The musical instrument sound quality enhancement device according to claim 7 in which said circular shaped planer sound hole cover member is provided with a fret board detent cut-out.

9. A musical instrument sound quality enhancement device adapted to be detachably installed upon a musical instrument having a fret board mounted upon a hollow body disposing supportably therebetween a plurality of tensioned strings over a circular shaped sound hole opening in said hollow body and provided with an internally mounted acoustic electric pick-up head, comprising in combination said musical instrument, a circular shaped planer sound hole cover member having a topside planer surface and a parallelly spaced underside planer surface respectively with a circular dimension at least larger than that of said circular shaped sound hole opening to thereby provide a uniformily overlapping underside planer surface peripheral boundary adapted for supportable contact thereof about said circular shaped sound hole opening in said hollow body said underside surface being further provided with an integral pair of opposingly positioned underside set of spaced angularly outward and downward projecting pliable affixment fingers adapted to insertably engage said circular shaped sound hole opening and compressively conform by means of a resilient finger cam surface respectively provided upon each of said affixment fingers said underside planer surface peripheral boundary of said circular shaped planer sound hole cover member in sealable contact to said hollow body in which said circular shaped sound hole opening is disposed, and a rectangular shaped port opening provided in said circular shaped planer sound hole cover member said rectangular shaped port opening being adjustably occluded by means of a rectangular shaped sliding panel supportably operable cooperatively in manually set opening and closing thereof within a spaced set of panel support and guide tracks dependently integral to said parallelly spaced underside planer surface and adapted to be manually moveable in variable adjustment from a fully closed to a fully open position whereby in the fully closed position feedback interference through said sound hole opening to said internally mounted acoustic electric pick-up head is eliminated and in a manually adjusted variably open to the fully open set position a corresponding variation in tonal character of said musical instrument is realized.

10. The musical instrument sound quality enhancement device according to claim 9 in which said circular shaped planer sound hole cover member is provided with a fret board detent cut-out.

11. A musical instrument sound quality enhancement device adapted to be detachably installed upon a musical instrument having a fret board mounted upon a hollow body disposing supportably therebetween a plurality of tensioned strings over a circular shaped sound hole opening in said hollow body and provided with an internally mounted acoustic electric pick-up head, comprising in combination said musical instrument, a circular shaped planer sound hole cover member having a topside planer surface and a parallelly spaced underside planer surface respectively with a circular dimension at least larger than that of said circular shaped sound hole opening to thereby provide a uniformily overlapping underside planer surface peripheral boundary adapted for supportable contact thereof about said circular shaped sound hole opening in said hollow body said underside surface being further provided with an integral pair of opposingly positioned underside set of spaced angularly outward and downward projecting pliable affixment fingers adapted to insertably engage said circular shaped sound hole opening and compressively conform by means of a resilient finger cam surface respectively provided upon each of said affixment fingers said underside planer surface peripheral boundary of said circular shaped planer sound hole cover member in sealable contact to said hollow body in which said circular shaped sound hole opening is disposed, and a rectangular shaped port opening provided in said circular shaped planer sound hole cover member said rectangular shaped port opening being adjustably occluded by means of a rectangular shaped sliding panel supportably operable cooperatively in manually set opening and closing thereof within a spaced set of panel support and guide tracks dependently integral to said parallelly spaced underside planer surface and adapted to be manually moveable in variable adjustment from a fully closed to a fully open position whereby in a manually adjusted variably open to the fully open set position a corresponding variation in tonal character of said musical instrument is realized.

12. The musical instrument sound quality enhancement device according to claim 11 in which said circular shaped planer sound hole cover member is provided with a fret board detent cut-out.

* * * * *